US011217872B2

(12) United States Patent
Manley et al.

(10) Patent No.: US 11,217,872 B2
(45) Date of Patent: Jan. 4, 2022

(54) RF SENSOR HEAT SHIELD

(71) Applicant: Raytheon Company, Waltham, MA (US)

(72) Inventors: Robert T. Manley, Allen, TX (US); Waid A. Paine, Dallas, TX (US)

(73) Assignee: Raytheon Company, Waltham, MA (US)

( * ) Notice: Subject to any disclaimer, the term of this patent is extended or adjusted under 35 U.S.C. 154(b) by 10 days.

(21) Appl. No.: 16/796,302

(22) Filed: Feb. 20, 2020

(65) Prior Publication Data

US 2021/0265717 A1 Aug. 26, 2021

(51) Int. Cl.
*H01Q 1/00* (2006.01)
*H01Q 1/42* (2006.01)

(52) U.S. Cl.
CPC ..... *H01Q 1/002* (2013.01); *H01Q 1/42* (2013.01); *H01Q 1/425* (2013.01)

(58) Field of Classification Search
CPC ..... H01Q 1/002; H01Q 1/28; H01Q 1/42; H01Q 1/422; H01Q 1/425; H01Q 15/006; H01Q 15/0006
See application file for complete search history.

(56) References Cited

U.S. PATENT DOCUMENTS 3,925,783 A 12/1975 Bleday
5,208,603 A * 5/1993 Yee ..... H01Q 1/286 343/872
5,395,718 A * 3/1995 Jensen ..... G03F 1/68 343/708
5,691,736 A 11/1997 Hunn
7,082,878 B2 8/2006 Facciano
8,681,064 B2 * 3/2014 Isom ..... H01Q 15/0013 343/753
9,099,782 B2 * 8/2015 Ziolkowski ..... H01Q 1/424
9,362,615 B2 6/2016 Cannon
9,537,207 B2 1/2017 Keen
9,876,280 B1 1/2018 Pillans
10,128,566 B2 * 11/2018 Seghi ..... H01Q 1/427
10,164,326 B2 12/2018 Urcia
10,270,423 B2 4/2019 Wall
10,693,225 B2 * 6/2020 Stresing ..... B32B 27/08
2004/0219328 A1 * 11/2004 Tasaki ..... C22C 30/00 428/692.1
2013/0009846 A1 * 1/2013 Freitag ..... H01Q 1/281 343/872
2013/0214988 A1 * 8/2013 Brady ..... H01Q 15/0013 343/872

* cited by examiner

*Primary Examiner* — Dimary S Lopez Cruz
*Assistant Examiner* — Yonchan J Kim
(74) *Attorney, Agent, or Firm* — Renner, Otto, Boisselle & Sklar, LLP

(57) ABSTRACT

A radio-frequency (RF) heat shield for electronics includes a first and second outer skin formed of an insulating material, an insulating core layer arranged between the first and second outer skin, wherein the insulating core layer has a lower dielectric constant as compared with a higher dielectric constant of the first and second outer skin, and a frequency selective surface (FSS) layer including a reflective metallization pattern that is RF transparent and formed on an exterior surface of each of the first and second outer skin.

20 Claims, 4 Drawing Sheets

RF SENSOR HEAT SHIELD

FIELD OF THE INVENTION

The invention relates to a heat shield radome arranged to insulate sensor electronics from extreme external ambient temperatures.

DESCRIPTION OF THE RELATED ART

Various applications require thermal insulation of electronics that are subject to extreme temperature conditions, including both hot and cold temperatures. Exemplary applications include high speed aircrafts, missiles, re-entry vehicles, and other space-based platforms having radio-frequency (RF) sensor electronics that are subject to high external temperatures caused by aerodynamic heating or other heat sources.

Prior attempts to provide a heat shield for sensor electronics include using various materials as the heat shield material. Exemplary prior materials include titanium dioxide epoxy-filled paper and monolithic ceramic materials. However, conventional heat shield arrangements are disadvantageous in that the heat shields have a low thermal mass and will quickly equalize in temperature with the surrounding temperature, such that the shields effectively become a source of radiation heat transfer to the sensor electronics. Moreover, prior attempts are not effective at rejecting radiated heat and must absorb the majority of the radiated heat.

One method used to compensate for low thermal mass includes increasing the number of layers in the heat shield which consequently increases the overall thickness of the heat shield. However, increasing the thickness of the shield is disadvantageous in that RF losses are increased and the overall sensor performance is degraded.

SUMMARY OF THE INVENTION

An RF heat shield or radome described herein is used for insulating electronics, such as an antenna and RF sensors, from extreme external ambient temperatures. In exemplary applications, the RF heat shield may be formed as a secondary radome arranged within an exterior radome between the exterior radome and the sensor electronics. In other exemplary applications, the RF heat shield may be exposed without an exterior radome. The RF heat shield is configured for both thermal insulation and low loss RF transmission using two higher dielectric outer skins that sandwich a lower dielectric, low loss tangent insulating core material that provides low RF loss and a wide RF bandwidth. The described configuration may be known as an A-sandwich construction. A frequency selective surface (FSS) metallization pattern is formed on the exterior surfaces of both outer skins to form an RF transparent surface. While the forward low emissivity surface is advantageous in rejecting radiation heat transfer from the external environment into the RF heat shield, the aft FSS layer advantageously impedes the ability of the RF heat shield to re-radiate any radiation heat transfer from the RF heat shield to the antenna and the sensor electronics. Thus, radiation heat transfer to the sensor electronics is minimized.

The present application provides an RF heat shield having improved insulation for a sensor and sensor electronics. The RF heat shield is configured to insulate the sensor while minimizing RF losses by rejecting 75% or more of the radiated heat which minimizes the amount of insulating material required to protect the sensor which minimizes the RF losses. The insulating core of the RF heat shield may only absorb the remaining 25% that gets through the FSS layer as compared with prior attempts in which 80% to 90% of the radiated heat is absorbed. Advantageously, the insulating effect is greatly improved without the need of adding excessive amounts of insulating material which degrades RF performance.

The FSS metallization pattern is formed of a highly reflective metal, such as polished gold, and has a pattern of spaced openings that enable RF transmission. Forming the FSS metallization pattern on the exterior surface of the radome skin is advantageous as compared with conventional FSS surfaces that are imbedded inside the radome skins which negates the emissivity effect and enables heat transfer by conduction. The FSS may be formed to have any suitable pattern and thickness such that the FSS is able to support wide frequency bands of operation with low RF loss.

The RF heat shield may be formed as an A-sandwich construction formed of three layers of high-temperature resistant materials. The layers are configured to provide low loss RF transmission and high thermal insulation in extreme temperature environments while also maintaining low RF losses. The outer skins may be formed of quartz and the core material may be formed of a low-density and fibrous ceramic insulator that provides low thermal conductivity. Using an A-Sandwich configuration has the additional advantage of allowing a very low dielectric and very low loss tangent insulating material that can be made thicker which further enhances the insulating properties of the heat shield with minimal effect to RF losses.

The A-sandwich construction enables increasing the thickness of the radome structure with additional low dielectric, low loss tangent insulator material, increasing the thermal insulating properties, and thermal mass without increasing the RF losses of the radome. The thicknesses of the outer skins and the center core can be tuned for the desired frequency of operation and desired bandwidth, consistent with standard A-Sandwich radome configurations. Additionally, the exterior FSS metallization pattern rejects the majority of the radiation heat transfer minimizing the insulation requirements of the internal core. Advantageously, the thickness of the RF heat shield may be increased while maintaining the same low RF losses as compared with a conventional monolithic heat shield in which RF losses are increased as the thickness of the shield is increased.

In another exemplary embodiment, the RF heat shield may have a C-sandwich construction formed of five layers that are similar to the layers of the A-sandwich construction. The C-sandwich construction further includes an additional inner skin and insulating core sublayers arranged between the inner skin and the outer skins.

In an exemplary embodiment of the RF heat shield, the core insulating layer may be formed as a vacuum chamber or air-filled chamber between the radome skins. Forming the core insulating layer as a vacuum chamber is further advantageous in minimizing the heat transfer between the radome skins.

According to an aspect of the invention, an RF heat shield for an antenna and sensor electronics includes outer skins, an insulating core layer arranged between the outer skins, and an FSS layer formed on an exterior surface of the outer skins.

According to an aspect of the invention, an RF heat shield for an antenna and sensor electronics includes a forward low emissivity surface that rejects radiation heat transfer from an external environment into the RF heat shield, and an aft FSS layer that impedes the ability of the RF heat shield to re-radiate any radiation heat transfer from the RF heat shield to the electronics.

According to an aspect of the invention, an RF heat shield for electronics includes a first and second outer skin formed of an insulating material, an insulating core layer arranged between the first and second outer skin, with the insulating core layer having a lower dielectric constant as compared with a higher dielectric constant of the first and second outer skin, and an FSS layer including a reflective metallization pattern that is RF transparent at a predetermined frequency range and formed on an exterior surface of each of the first and second outer skin.

According to an embodiment of any paragraph(s) of this summary, the higher dielectric constant may be between 3.0 and 4.5, the lower dielectric constant may be 1.4 or less, and a loss tangent of both the first and second outer skin and the insulating core layer may be 0.005 or less.

According to an embodiment of any paragraph(s) of this summary, the insulating material may be quartz.

According to an embodiment of any paragraph(s) of this summary, the FSS layer may be formed of a pure metal material that is gold, silver, or copper.

According to an embodiment of any paragraph(s) of this summary, the FSS layer may have a thickness that is between 0.02 and 0.2 microns.

According to an embodiment of any paragraph(s) of this summary, the reflective metallization pattern may have a plurality of spaced open regions and is formed to cover between 75% and 95% of the exterior surface of each of the first and second outer skin.

According to an embodiment of any paragraph(s) of this summary, the insulating core layer may be formed of a fibrous ceramic material.

According to an embodiment of any paragraph(s) of this summary, the first and second outer skin and the insulating core layer may be laminated to each other.

According to an embodiment of any paragraph(s) of this summary, the insulating core layer may be formed by a vacuum canister, with the vacuum canister containing a vacuum or air.

According to an embodiment of any paragraph(s) of this summary, the RF heat shield may include side wall rings or stand-off posts that extend along the insulating core layer between the first and second outer skin, with the side wall rings or stand-off posts being formed of another insulating material.

According to an embodiment of any paragraph(s) of this summary, the side wall rings or the stand-off posts and the first and second outer skin may be formed of quartz.

According to an embodiment of any paragraph(s) of this summary, the RF heat shield may include bond joints that are formed of a ceramic-based adhesive between the side wall rings and the first and second outer skin.

According to an embodiment of any paragraph(s) of this summary, the RF heat shield may include bond joints that are formed of a fused connection between the side wall rings and the first and second outer skin, with a vacuum enclosure being formed to define the core insulating layer.

According to an embodiment of any paragraph(s) of this summary, the RF heat shield may include an inner skin formed of the insulating material of the first and second outer skin, with the insulating core layer being formed of a first insulating core sublayer arranged between the first outer skin and the inner skin and a second insulating core sublayer arranged between the inner skin and the second outer skin.

According to another aspect of the invention, a radome structure includes an exterior radome, an RF antenna and corresponding sensor electronics arranged in the external radome, and an RF heat shield arranged between the exterior radome and the RF antenna and corresponding sensor electronics. The RF heat shield includes a first and second outer skin formed of an insulating material, an insulating core layer arranged between the first and second outer skin, with the first and second outer skin having a higher dielectric constant that is between 3.0 and 4.5, the insulating core layer having a lower dielectric constant that is 1.4 or less, and a loss tangent of both the first and second outer skin and the insulating core layer being 0.005 or less, and an FSS layer including a reflective metallization pattern that is RF transparent at a predetermined frequency range and formed on an exterior surface of each of the first and second outer skin.

According to an embodiment of any paragraph(s) of this summary, the FSS layer may be formed of a pure metal that is gold, silver, or copper, with the reflective metallization pattern having a plurality of spaced open regions and being formed to cover between 75% and 90% of each of the exterior surface of the first and second outer skin.

According to an embodiment of any paragraph(s) of this summary, the RF heat shield may include side wall rings or stand-off posts that are formed of another insulating material and extend along the insulating core layer between the first and second outer skin.

According to an embodiment of any paragraph(s) of this summary, the insulating core layer may be formed as an enclosed vacuum chamber.

According to still another aspect of the invention, a method of forming an RF heat shield for electronics includes selecting an insulating material for outer skins that have a dielectric constant between 3.0 and 4.5 and a loss tangent that is 0.002 or less, selecting another insulating material for an insulating core layer that has a lower dielectric constant than the dielectric constant of the outer skins and a loss tangent that is 0.005 or less, selecting thicknesses of the outer skins and the insulating core layer to obtain a predetermined frequency range, applying a reflective FSS metallization pattern that is RF transparent on an exterior surface of each of the outer skins using lithography and metal deposition, and sandwiching the insulating core layer between the outer skins.

According to an embodiment of any paragraph(s) of this summary, the method may include fusing the outer skins to insulating side wall rings of a container defining the insulating core layer thereby forming a vacuum in the insulating core layer.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

The principles described herein have particular application in RF communication applications including antenna and radar systems that contain sensors and sensor electronics. Suitable platforms for the RF heat shield described herein include aircrafts, space vehicles, high speed vehicles, or any other space application in which a platform is exposed to extreme temperature environments. Extreme temperature environments may include those in which the platform is exposed to radiation from the sun or cold temperature environments. The platform may be manned or unmanned and defense applications or non-military applications may be suitable. For example, missiles and satellites are both suitable applications.

Figure 1:
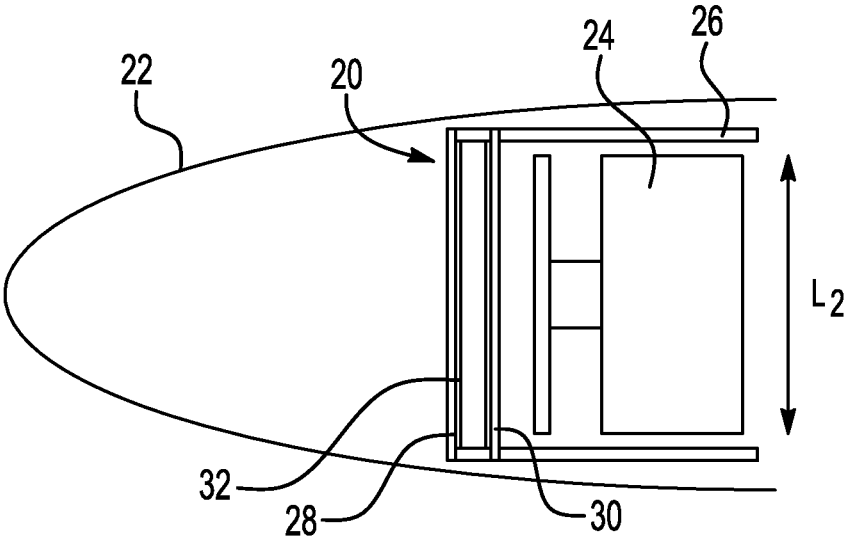
FIG. 1 shows an RF heat shield for electronics arranged in an exterior radome according to an exemplary embodiment of the present application.
Figure 2:
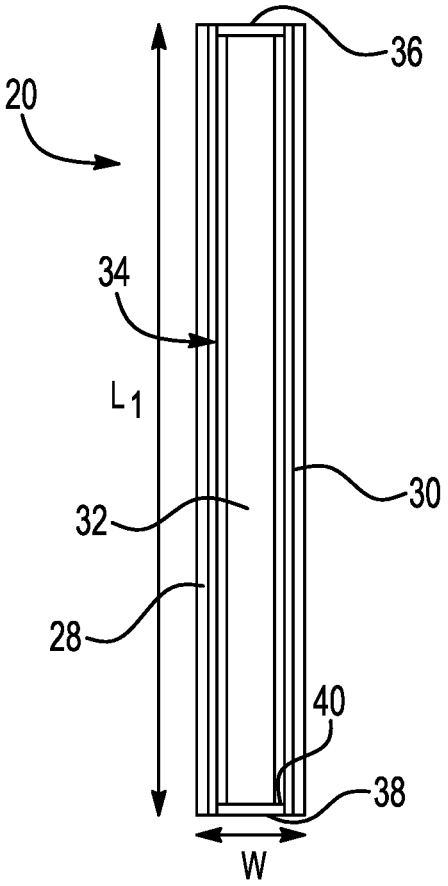
FIG. 2 shows a side view of the RF heat shield of FIG. 1.

Referring first to FIGS. 1 and 2, an RF heat shield 20 may be arranged in an exterior radome 22 as a secondary radome. An RF antenna and corresponding sensor electronics 24 are arranged in the exterior radome 22 and the RF heat shield 20 is arranged between the sensor antenna and electronics 24 and the exterior radome 22. The RF heat shield 20 is configured to thermally insulate the sensor antenna and electronics 24 from radiation heat transfer from the exterior radome 22 while also enabling forward RF transmission. In exemplary applications, the RF heat shield 20 may be mounted relative to the sensor antenna and electronics 24 without an exterior radome, such as in a satellite application or in any other application in which the sensor antenna and electronics are not susceptible to damage by being exposed.

A radial mounting structure or canister 26 may be used for mounting the RF heat shield 20 to the exterior radome 22 and is also configured to provide thermal isolation from radial heat transfer. A metal canister or frame may be provided as the radial mounting structure 26. Any suitable mounting structure that protects the sides of the sensor antenna and electronics 24 may be provided and any suitable materials that provide electrical and thermal insulation may be used to form the radial mounting structure 26. Ceramic materials may be suitable. The radial mounting structure 26 may be configured as a vacuum canister to provide additional thermal insulation from radial heat transfer. The vacuum canister may be configured with low emissivity surfaces to further reject radiation heat transfer towards the sensor.

The RF heat shield 20 may have a planar arrangement that is formed of a plurality of planar layers that are stacked relative to each other and configured for both thermal and electrical insulation. The layers in the planar arrangement may have any suitable shape, such as rectangular or cylindrical. The RF heat shield 20 may be shaped for integration with any conformal structure that surrounds the antenna and electronics 24, such as a vacuum canister. Other shapes may be suitable and the shapes may be dependent on the application. In other exemplary embodiments, the RF heat shield 20 may have a plurality of stacked layers formed in a hemispherical shape. In any embodiment, the RF heat shield 20 includes outer layers or skins 28, 30 that extend parallel to each other and an insulating core layer 32 that is interposed or sandwiched between the outer skins 28, 30 to minimize heat transfer between the outer skins 28, 30.

The outer skins 28, 30 may have a length $L_1$ that is greater than a corresponding length $L_2$ of the sensor antenna and electronics 24, such that the outer skins 28, 30 extend over an entire surface of the sensor antenna and electronics 24. One outer skin 30 of the outer skins 28, 30 is arranged proximate the sensor antenna and electronics 24 and the other outer skin 28 is arranged on an opposing side of the insulating core layer 32. The length $L_1$ of the outer skins 28, 30 defines the total length of the RF heat shield 20 and the length $L_1$ is elongated as compared with a width W of the RF heat shield 20. The skins 28, 30 may have different lengths. For example, forming the skin 30 to have a wider diameter may be advantageous for attaching the RF heat shield 20 to the mounting structure.

The outer skins 28, 30 are formed of any suitable material that has a high temperature resistance, a low dielectric constant that is higher than that of the insulating core layer 32, a low loss tangent, and is able to withstand a metallization process. The dielectric constant is defined as the ratio of the material permittivity to the permittivity of vacuum, or the relative permittivity. The loss tangent is defined as the ratio (or angle in a complex plane) of the lossy reaction to the electric field to the lossless reaction. Loss tangent is a measure of the dissipative loss of RF fields as they propagate through dielectric materials. For a dielectric material, an applied electric field causes the polarization of atoms/molecules of the materials to create electric dipole moments that create dissipation losses, i.e. heat, due to damping of the vibrating dipole moments of the polarized atoms/molecules that result in RF losses as electromagnetic fields propagate through dielectric materials.

In an exemplary embodiment, any material having a temperature resistance of up to 1200 degrees Celsius, a dielectric constant that is between 3.0 and 4.5 (relative to vacuum), and a low loss tangent that is less than 0.002 may be suitable. In an exemplary embodiment, the material may have a dielectric constant that is approximately 3.8 and a low loss tangent that is approximately 0.001. The material may have an emissivity that is between 0.4 and 0.95. Suitable materials for the outer skins 28, 30 include quartz or fused silica. Other materials may be suitable, such as glass or other manufactured ceramic materials.

In an exemplary embodiment of the insulating core layer 32, the insulating core layer 32 may be formed of a material having a high temperature resistance, a low dielectric constant and a low loss tangent, such as a temperature resistance of up to 1200 degrees Celsius, a dielectric constant that is 1.4 or less and a low loss tangent that is 0.005 or less. The material dielectric constant of the insulating core layer 32 is less than the dielectric constant of the outer skins 28, 30. Using a low loss tangent core material is advantageous in providing low RF losses for the antenna and sensor electronics 24.

The material of the insulating core layer 32 may be a low density and fibrous ceramic material having a low thermal conductivity. For example, a silica ceramic material may be suitable. The material may have a density that is between 0.2 and 0.9 grams per cubic centimeter and a thermal conductivity that is between 0.02 and 0.20 watts per meter-Kelvin. The insulating core layer 32 may have any suitable structure, such as a honeycomb type structure or any other porous structure. A ceramic foam material having a porosity that is between 50% and 95% may be suitable. The material may further include silica aerogel or any other suitable material to further lower the thermal conductivity of the insulating core layer 32. Many other materials may be suitable for the insulating core layer 32.

The insulating core layer 32 formed of the low dielectric, low loss tangent material is advantageous in providing low RF losses and wide RF bandwidths. Furthermore, the insulating core layer 32 may be optimized for a desired frequency range by adjusting the thickness of the outer skins 28, 30 and the insulating core layer 32.

The RF heat shield 20 may be configured as an A-sandwich type construction having the three layers formed by the skins and the core. Forming the RF heat shield 20 as an A-sandwich construction is advantageous in that the thickness of the layers may be adjusted to increase the thermal mass of the RF heat shield 20 while maintaining low RF losses as compared with conventional monolithic heat shields in which RF losses are increased as the thickness is increased. A width of the insulating core layer 32 may be greater than a width of each of the outer skins 28, 30. The width of the insulating core layer 32 may be greater than twice the width of the outer skin 28, 30. In an exemplary embodiment, the thicknesses of the outer skins 28, 30 may be approximately two millimeters or less and the thickness of the insulating core layer 32 may be four millimeters or more. The thicknesses of the skins 28, 30 and the insulating core layer 32 are frequency dependent and may have any suitable thickness.

In another exemplary embodiment, the RF heat shield 20 may be configured as a C-sandwich type construction that includes five layers which are similar to those of the A-sandwich construction. The outer skins 28, 30 are formed to be as thin as possible to maximize the frequency bandwidth. The thickness of the outer skins 28, 30 may be formed based on structural requirements that accommodate shock, vibration, and pressure loading. The frequency band of operation typically drives the core thickness. Typically the center core thickness is 10 to 20 times the thickness of the skin thickness.

The RF heat shield 20 may further include an air gap 34 defined between each of the outer skins 28, 30 and the insulating core layer 32. The air gap 34 may extend along the entire length $L_1$ of the outer skins 28, 30 and the air gap 34 may have a thickness that is less than the thickness of the outer skins 28, 30. Providing the air gap 34 is advantageous in providing a further electrical and thermal insulation effect. Many other thicknesses are possible and the thicknesses are dependent on the application.

The outer skins 28, 30 may be connected to side wall rings 36, 38 that extend along the thickness of the insulating core layer 32 between the outer skins 28, 30. The side wall rings 36, 38 may extend parallel with each other and the outer perimeter of the RF heat shield 20 may be defined by the outer skins 28, 30 and the side wall rings 38, 38. The side wall rings 36, 38 may be formed of any suitable insulating material and may form the canister, such as the canister 26 shown in FIG. 1, that defines the insulating core layer 32. Quartz or fused silica may be suitable materials for the side wall rings 36, 38. The outer skins 28, 30 may be formed as planar disks or any other suitable shape.

A bond joint 40 may be connected between each outer skin 28, 30 and a corresponding side wall ring 36, 38. Any suitable method may be used to form the bond joint 40. For example, the bond joint 40 may be formed using a high temperature-resistant ceramic-based adhesive material and adhering the outer skins 28, 30 to the canister. A high temperature epoxy or cement may be used. The epoxying process may be suitable for bonding the outer skins 28, 30 formed of quartz to the insulating material of the canister.

In another exemplary embodiment, the side wall rings 36, 38 may be machined and the outer skins 28, 30 may be laminated to the outside surface of the side wall rings 36, 38. Many other bonding materials and manufacturing methods may be suitable. In still other exemplary embodiments, the RF heat shield 20 may include the outer skins 28, 30 and the insulating core layer 32 without the side wall rings and with the outer skins 28, 30 and the core insulating layer 32 being laminated.

In still other exemplary embodiment, the side wall between the outer skins 28, 30 may be a continuous ring, or include multiple stand-off posts to maintain a predetermined separation of the outer skins 28, 30. The side wall may be formed of the same material as the outer skins 28, 30, or any other suitable materials that meet the structural requirements of the application. For example, a higher density structural insulator material may be suitable. The attachment may be formed by fusing the similar skin and side wall (or stand-off post) materials to form the joint.

In another exemplary embodiment of the RF heat shield 20, the insulating core layer 32 may be formed as a vacuum chamber or an air-filled chamber between the outer skins 28, 30. Forming the insulating core layer 32 as a vacuum chamber is advantageous in further increasing the insulation effect of the insulating core layer 32. In the exemplary embodiment in which the insulating core layer 32 is formed as the vacuum chamber, the side wall rings 36, 38 define walls of the canister such that the canister is a vacuum canister. The canister may be formed of quartz or any other suitable material and both the canister and the outer skins 28, 30 may be formed of quartz. The vacuum in the insulating core layer 32 may be formed by fusing the outer skins 28, 30 to the side wall rings 36, 38 at each bond joint 40.

Figure 3:
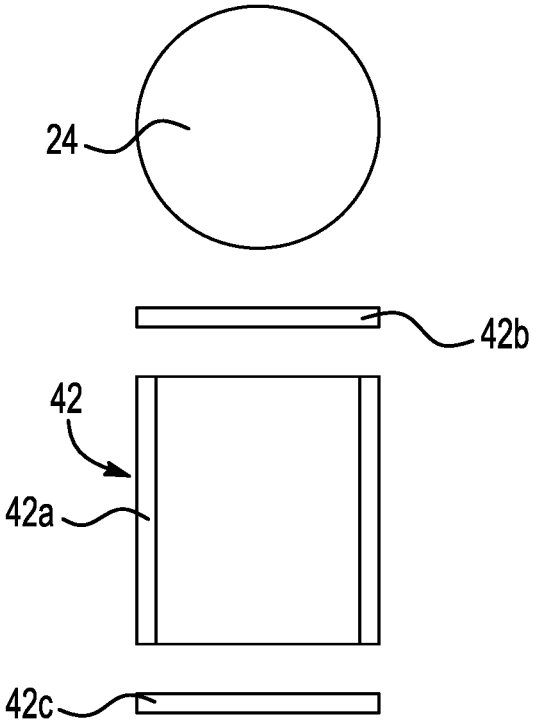
FIG. 3 shows a construction of a vacuum canister formed of quartz or a similar material.
Figure 4:
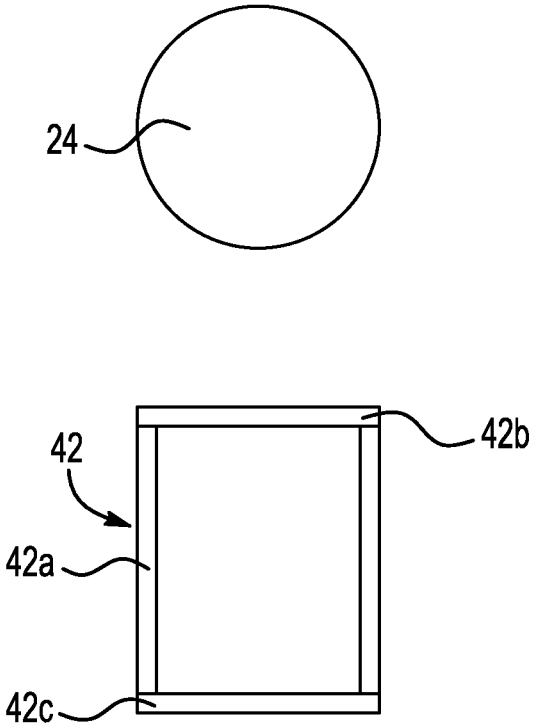
FIG. 4 shows a quartz ring and two quartz skins that are fused together in a vacuum to form a hermetic vacuum canister.

FIGS. 3 and 4 show a construction of a vacuum canister 42 formed entirely of quartz or a similar material. The vacuum canister 42 includes a quartz ring 42*a* and two quartz skins 42*c*, 42*d* that are fused together in a vacuum to form the hermetic vacuum canister 42.

Figure 5:
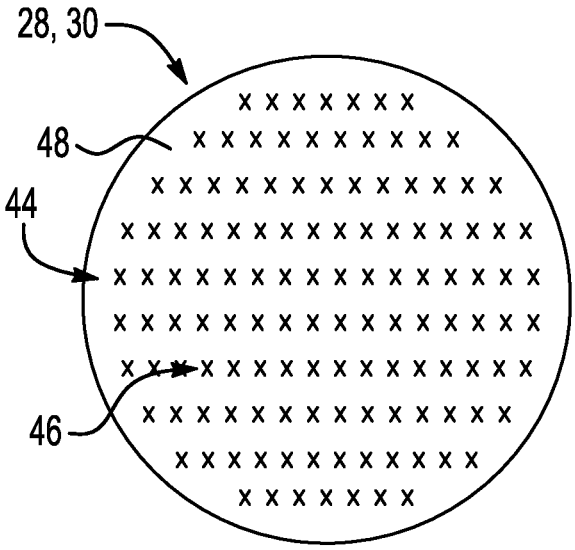
FIG. 5 shows an FSS metallization pattern formed on an exterior surface of the outer skins of the RF heat shield of FIG. 1 according to an exemplary embodiment of the present application.

Referring now to FIG. 5, a frequency selective surface (FSS) layer 44 including a reflective metallization pattern 46 that is RF transparent is formed on an outermost or exterior surface 48 of each of the outer skins 28, 30 opposite to the insulating core layer arranged inside the outer skins 28, 30. While the forward low emissivity surface is advantageous in rejecting radiation heat transfer from the external environment into the RF heat shield 20, forming the FSS layer 44 on the exterior surface 48 of the outer skins 28, 30 is advantageous in that the aft FSS layer 44 provides an RF transparent surface that impedes the ability of the RF heat shield 20 to re-radiate any radiation heat transfer from the RF heat shield 20 to the antenna and the sensor electronics. The low emissivity effect is advantageous as compared with conventional FSS surfaces that are imbedded inside the radome skins such that heat transfer occurs by conduction.

The FSS layer 44 is formed of any suitable metal material, such as gold, silver, or copper. Other pure, non-coated, and reflective metals that are suitable for lithography may be used. The FSS layer 44 is planar and may be formed by any suitable manufacturing process, such as lithography and metal deposition processes. A thickness of the FSS layer 44 is selected based on the electrical requirements of the application and the thickness of the FSS layer 44 is significantly less than the thickness of the outer skins 28, 30. For example, the FSS layer 44 may have a thickness that is between 0.02 and 0.2 microns. The FSS layer 44 is formed to have a minimal thickness without the material, such as gold, being translucent. The thickness of the FSS layer 44 is selected to maximize an amount of the metal material surface area thereby minimizing the emissivity of the FSS layer 44 to prevent heat transfer radiation. For example, the FSS layer 44 may be formed to provide an emissivity that is between 0.1 and 0.25.

In an exemplary embodiment, an adhesion metal deposition may be applied between the gold layer and dielectric skin. The adhesion metal deposition increases the adhesion strength between the gold and dielectric skin to ensure that the gold metallization does not delaminate under high temperature exposure due to the differing coefficients of thermal expansion (CTE) of the gold and dielectric skin material. Suitable materials include titanium tungsten, titanium platinum gold, tantalum nitride or any other suitable materials. A thickness of the adhesion layer is between 30 and 300 nanometers.

Referring in addition to FIGS. 6-12, any suitable reflective metallization pattern 46 for the FSS layer 44 may be used and the pattern may be dependent on the application. The metallization pattern 46 may be formed to cover between 75% and 95% of the surface area for the outer skin 28, 30, such that the pattern 46 is formed to minimize the amount of open regions in which the dielectric material of the outer skin 28, 30 is exposed. The amount of coverage of the metallization pattern 46 is also selected to enable a predetermined amount of RF passage such that the amount of coverage is dependent on the electrical requirements of the application. The sizes, dimensions, and spacing of the pattern 46 may be selected based on the frequency and scan angle of the antenna.

Figure 6:
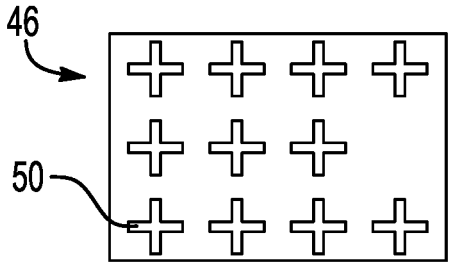
FIG. 6 shows the FSS metallization pattern of FIG. 5 according to another exemplary embodiment in which the open regions are formed as crosses.
Figure 7:
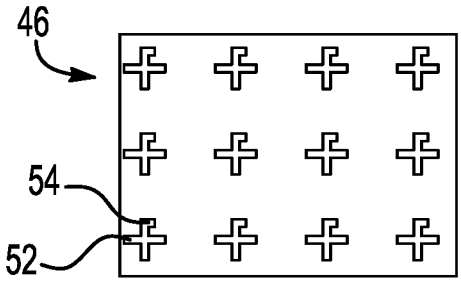
FIG. 7 shows the FSS metallization pattern of FIG. 5 according to another exemplary embodiment in which the open regions are formed as crosses with feet.
Figure 8:
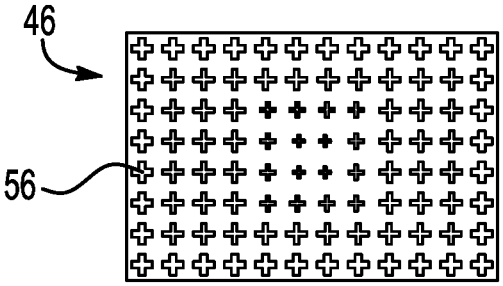
FIG. 8 shows the FSS metallization pattern of FIG. 5 according to another exemplary embodiment in which the open regions are formed as crosses having different sizes.

The metallization pattern 46 may be an ordered pattern that includes a periodic series of open regions or features in the metal material. The open regions may be formed as slots, x's, crosses, circles, squares, combinations thereof, or any other suitable shapes. The open regions enable passage of RF through the FSS layer 44. FIG. 5 shows x's that are arranged in ordered columns and rows along the surface area of the outer skin 28, 30. FIG. 6 shows crosses 50 and FIG. 7 shows the crosses 52 having projecting feet 54 at the tops of the crosses 52. The open regions may have an unordered pattern with different sizes and non-uniform spacings. For example, FIG. 8 shows crosses 56 having different sizes such that the spacing between the crosses 56 is also non-uniform.

Figure 9:
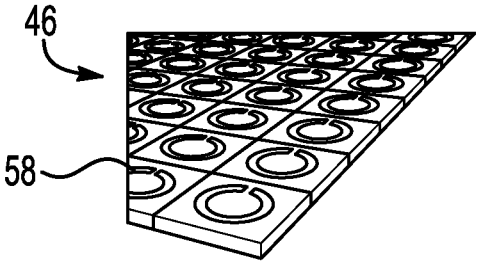
FIG. 9 shows the FSS metallization pattern of FIG. 5 according to another exemplary embodiment in which the open regions have a ring shape.
Figure 10:
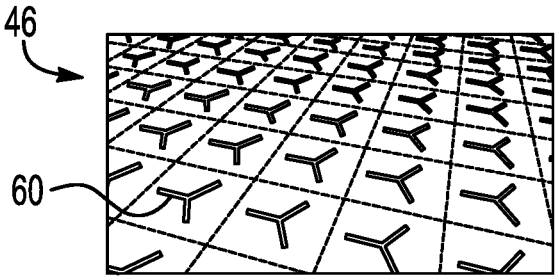
FIG. 10 shows the FSS metallization pattern of FIG. 5 according to another exemplary embodiment in which the open regions have a y-shape.
Figure 11:
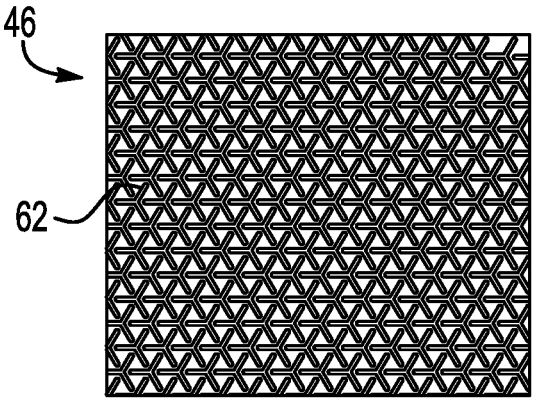
FIG. 11 shows the FSS metallization pattern of FIG. 5 according to another exemplary embodiment in which the open regions have a y-shape and are spaced more tightly as compared with the open regions of FIG. 10.

FIGS. 9, 10, and 11 shows the open regions being formed as other shapes. FIG. 9 shows the open regions being formed as rings 58. As shown in FIG. 9, the rings 58 may be non-continuous and have a gap in the ring. FIG. 10 shows the open regions having a y-shape 60 and a predetermined spacing between the open regions. FIG. 11 shows the open regions having a y-shape 62 and being spaced more tightly as compared with the open regions of FIG. 10.

Figure 12:
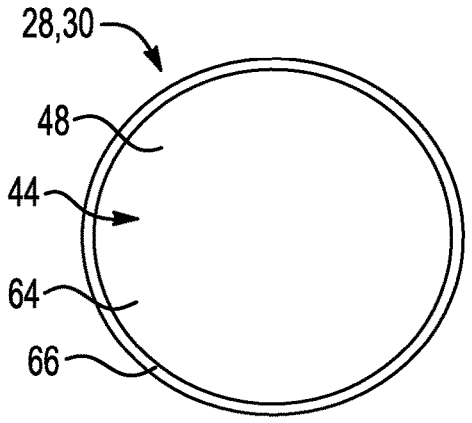
FIG. 12 shows the FSS metallization pattern of FIG. 5 according to another exemplary embodiment in which the open region is formed as a ring around the periphery of the outer skin.

FIG. 12 shows still another embodiment of the FSS layer 44. The exterior surface 48 of the outer skin 28, 30 includes the metal layer 64 deposited in the center of the exterior surface 48 and the open region is formed as a ring 66 that surrounds the metal layer 64. The arrangements of the FSS layer 44 shown in FIGS. 5-12 are merely exemplary and many other shapes and patterns are suitable.

Figure 13:
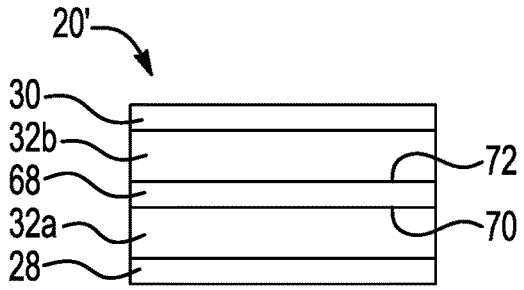
FIG. 13 shows the RF heat shield having a C-sandwich construction according to another exemplary embodiment of the present application.

Referring now to FIG. 13, in an exemplary embodiment, the RF heat shield 20' may have a C-sandwich construction having five layers, as compared with the A-sandwich construction having three layers shown in FIGS. 1 and 2. The C-sandwich construction may also be a planar arrangement having planar layers that are similar to the layers of the RF heat shield 20 having the A-sandwich construction. The layers in the C-sandwich arrangement include the outer skins 28, 30, which are similar to the outer skins 28, 30 of the RF heat shield 20 having the A-sandwich construction, and an additional inner skin 68. The inner skin 68 is arranged in the middle of the C-sandwich construction and is formed as a single layer. The inner skin 68 may be formed of the same material as the outer skins 28, 30 and the material may be any material previously described as being suitable for the outer skins 28, 30. For example, the outer skins 28, 30 and the inner skin 68 may be formed of quartz or any material having similar properties to quartz.

The insulating core layer may be formed of a first insulating core sublayer 32*a* arranged between the outer skin 28 and the inner skin 68, and a second insulating core sublayer 32*b* arranged between the inner skin 68 and the outer skin 30. The insulating core sublayers 32*a*, 32*b* may be formed of the same material or each insulating core sublayer 32*a*, 32*b* may be formed as a vacuum chamber. The materials previously described as being suitable for the insulating core layer 32 of the RF heat shield 20 having the A-sandwich construction are also suitable for the insulating core sublayers 32*a*, 32*b* of the RF heat shield 20 having the C-sandwich construction. For example, the insulating core layers 32*a*, 32*b* may be formed of a low-density, fibrous ceramic material. Forming the RF heat shield 20' to have a C-sandwich construction having more layers than an A-sandwich construction may be advantageous in particular applications for increasing the insulation effect of the heat shield.

In an exemplary embodiment, the inner skin 68 may also have a metallization pattern formed on the opposing faces 70, 72 of the inner skin 68 that face the insulating core sublayers 32*a*, 32*b*. The metallization patterns may be similar to any of the metallization patterns 46 shown in FIGS. 5-12 and previously described. Any suitable material or method may be used to form the metallization pattern. Forming the metallization patterns on the inner skin 68 may be particularly advantageous in an embodiment in which the insulating core sublayers 32*a*, 32*b* are formed as vacuum chambers.

Figure 14:
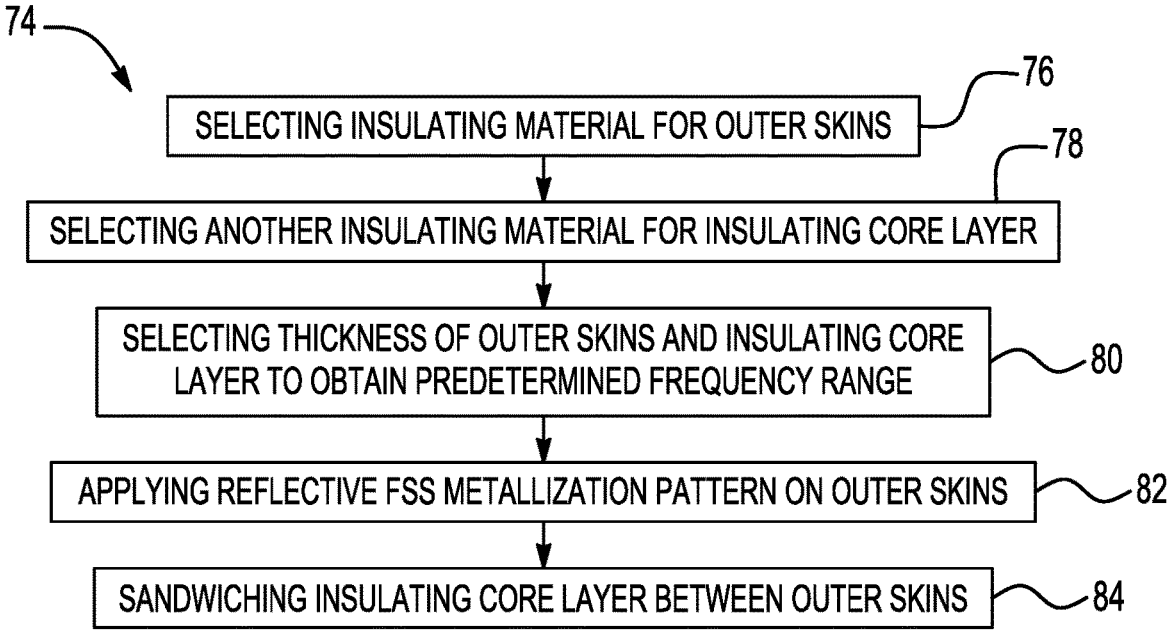
FIG. 14 shows a flowchart for a method of forming the RF heat shield shown in any of FIGS. 1-13.

Referring now to FIG. 14, a flowchart showing a method 74 of forming an RF heat shield for electronics is shown. The RF heat shield 20, 20' having any of the features previously shown and described may be formed using the method 74 and the RF heat shield 20, 20' may be arranged in the exterior radome 22 (as shown in FIG. 1) or exposed to the environment. A first step 76 of the method 74 includes selecting an insulating material for the outer skins 28, 30 (as shown in FIGS. 1 and 2). The material may have a dielectric constant that is between 3.0 and 4.5 and a loss tangent that is 0.002 or less. For example, the material may be quartz.

A next step 78 of the method 74 includes selecting another insulating material for the insulating core layer 32 (as shown in FIGS. 1 and 2). The insulating material for the insulating core layer 32 has a lower dielectric constant than the dielectric constant of the outer skins and a loss tangent that is 0.005. The lowest loss tangent possible may be used. For example, the material of the insulating core layer 32 may be a low-density and fibrous ceramic material that provides low thermal conductivity. The insulating core layer 32 may be formed of a porous ceramic foam material. The materials of both the outer skin 28, 30 and the insulating core layer 32 are selected to temperature resistant. For example, the layers 28, 30, 32 may have a high-temperature resistance of up to 1200 degrees Celsius. Other operating temperatures that are less than 1200 degrees may be suitable. A core material with lower thermal conductivity, but higher loss tangent may be used to optimize thermal performance over electrical performance, or a core material with slightly higher thermal conductivity to achieve the lowest possible loss tangent may be used to optimize electrical performance.

A step 80 of the method 74 includes selecting thicknesses of the outer skins 28, 30 and the insulating core layer 32 to obtain a predetermined frequency range that is dependent on the application. A step 82 of the method 74 includes applying a reflective FSS metallization pattern 46 that is RF transparent on an exterior surface 48 of each of the outer skins 28, 30 (as shown in FIG. 5) using lithography and metal deposition. Other methods may be suitable. Any suitable material and pattern, such as the patterns shown in FIGS. 5-12, may be formed. For example, the FSS metallization pattern 46 may be formed of pure gold and provide coverage of the outer skin 28, 30 that is between 75% and 95%. The percentage may be selected to optimize emissivity and lower the electrical performance or optimize electrical performance and lower the emissivity. Accordingly, lower coverage percentages, such as around 50% may also be suitable. Other pure, reflective metal materials may also be suitable.

After performing the metallization patterning, the RF heat shield 20, 20' is assembled. A step 84 of the method 74 includes sandwiching the insulating core layer 32 between the outer skins 28, 30. Step 84 may include fusing the outer skins 28, 30 to insulating side wall rings 36, 38 of a container, in a vacuum, defining the insulating core layer 32 (as shown in FIGS. 3 and 4). Step 84 may include epoxying the outer skins 28, 30 to the side wall rings 36, 38 or laminating the outer skins 28, 30 to the insulating core layer 32. Step 84 may include fusing the outer skins 28, 30 to stand-off posts formed of the same material as the outer skins 28, 30.

The RF heat shield radome described herein is advantageous in that the FSS metallization pattern being formed on the exterior surfaces of the quartz radome skins forms an RF transparent surface that rejects radiation heat transfer into the heat shield, such that radiation heat transfer to the antenna and the sensor electronics is minimized. Forming the FSS metallization pattern on the exterior surface is particularly advantageous as compared with conventional FSS surfaces that are imbedded inside the radome skin and disadvantageously enable heat transfer by conduction. The aft FSS minimizes radiation heat transfer between the RF heat shield and the sensor antenna and electronics.

Using an A-sandwich construction is also advantageous in that the insulating materials are configured to be resistant to temperatures in extreme temperature environments, including hot and cold temperatures, while also maintaining low RF losses. The A-sandwich construction may be made thicker and have a higher thermal mass for a same RF loss as compared with conventional monolithic heat shields in which the RF losses are increased when the number of layers is increased. Forming the insulating core layer as a vacuum chamber may be advantageous in providing a further insulation effect.

Still another advantage is that the RF heat shield may be planar in construction to minimize reflection effects between the heat shield and the exterior radome. The structure of the heat shield enables the RF heat shield to be less complexly integrated to various conformal structures surrounding sensor electronics, such as a vacuum canister.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A radio-frequency (RF) heat shield for electronics, the RF heat shield being arranged within an exterior radome between the exterior radome and the electronics, the RF heat shield comprising:

a first and second outer skin formed of an insulating material;

an insulating core layer arranged between the first and second outer skin, wherein the insulating core layer has a lower dielectric constant as compared with a higher dielectric constant of the first and second outer skin; and a frequency selective surface (FSS) layer including a reflective metallization pattern that is RF transparent at a predetermined frequency range and formed on an outermost surface of each of the first and second outer skin, the RF heat shield being configured for forward RF transmission and for thermally insulating the electronics from radiation heat transfer from the exterior radome.

2. The RF heat shield according to claim 1, wherein the higher dielectric constant is between 3.0 and 4.5, the lower dielectric constant is 1.4 or less, and a loss tangent of both the first and second outer skin and the insulating core layer is 0.005 or less.

3. The RF heat shield according to claim 1, wherein the insulating material is quartz.

4. The RF heat shield according to claim 1, wherein the FSS layer is formed of a pure metal material that is gold, silver, or copper.

5. The RF heat shield according to claim 1, wherein the FSS layer has a thickness that is between 0.02 and 0.2 microns.

6. The RF heat shield according to claim 1, wherein the reflective metallization pattern has a plurality of spaced open regions and is formed to cover between 75% and 95% of the outermost surface of each of the first and second outer skin.

7. The RF heat shield according to claim 1, wherein the insulating core layer is formed of a fibrous ceramic material.

8. The RF heat shield according to claim 1, wherein the first and second outer skin and the insulating core layer are laminated to each other.

9. The RF heat shield according to claim 1, wherein the insulating core layer is formed by a vacuum canister, wherein the vacuum canister contains a vacuum or air.

10. The RF heat shield according to claim 1 further comprising side wall rings or stand-off posts that extend along the insulating core layer between the first and second outer skin, wherein the side wall rings or stand-off posts are formed of another insulating material.

11. The RF heat shield according to claim 10, wherein the side wall rings or the stand-off posts and the first and second outer skin are formed of quartz.

12. The RF heat shield according to claim 10 further comprising bond joints that are formed of a ceramic-based adhesive between the side wall rings and the first and second outer skin.

13. The RF heat shield according to claim 10 further comprising bond joints that are formed of a fused connection between the side wall rings and the first and second outer skin, whereby a vacuum enclosure is formed to define the core insulating layer.

14. The RF heat shield according to claim 10 further comprising an inner skin formed of the insulating material of the first and second outer skin, and wherein the insulating core layer is formed of a first insulating core sublayer arranged between the first outer skin and the inner skin and a second insulating core sublayer arranged between the inner skin and the second outer skin.

15. A radome structure comprising:

an exterior radome;

an RF antenna and corresponding sensor electronics arranged in the external radome; and an RF heat shield arranged between the exterior radome and the RF antenna and corresponding sensor electronics, the RF heat shield comprising:

a first and second outer skin formed of an insulating material;

an insulating core layer arranged between the first and second outer skin, wherein the first and second outer skin have a higher dielectric constant that is between 3.0 and 4.5, the insulating core layer has a lower dielectric constant that is 1.4 or less, and a loss tangent of both the first and second outer skin and the insulating core layer is 0.005 or less; and a frequency selective surface (FSS) layer including a reflective metallization pattern that is RF transparent and formed on an outermost surface of each of the first and second outer skin, the RF heat shield being configured for forward RF transmission and for thermally insulating the electronics from radiation heat transfer from the exterior radome.

16. The radome structure according to claim 15, wherein the FSS layer is formed of a pure metal that is gold, silver, or copper, and wherein the reflective metallization pattern has a plurality of spaced open regions and is formed to cover between 75% and 90% of each of the exterior surface of the first and second outer skin.

17. The radome structure according to claim 15, wherein the RF heat shield includes side wall rings or stand-off posts that are formed of another insulating material and extend along the insulating core layer between the first and second outer skin.

18. The radome structure according to claim 15, wherein the insulating core layer is formed as an enclosed vacuum chamber.

19. A method of forming an RF heat shield for electronics, the RF heat shield being configured to be arranged within an exterior radome between the exterior radome and the electronics, the method comprising:

selecting an insulating material for outer skins that have a dielectric constant between 3.0 and 4.5 and a loss tangent that is 0.002 or less;

selecting another insulating material for an insulating core layer that has a lower dielectric constant than the dielectric constant of the outer skins and a loss tangent that is 0.005 or less;

selecting thicknesses of the outer skins and the insulating core layer to obtain a predetermined frequency range;

applying a reflective FSS metallization pattern that is RF transparent at a predetermined frequency range on an outermost surface of each of the outer skins using lithography and metal deposition; and sandwiching the insulating core layer between the outer skins, the RF heat shield being configured for forward RF transmission and for thermally insulating the electronics from radiation heat transfer from the exterior radome.

20. The method according to claim 19 further comprising fusing the outer skins to insulating side wall rings of a container defining the insulating core layer thereby forming a vacuum in the insulating core layer.

* * * * *